United States Patent [19]

Osborne, Sr.

[11] 4,242,845

[45] Jan. 6, 1981

[54] CONNECTING HINGE SYSTEM FOR PREFABRICATED BUILDING FOLDABLE PANEL STRUCTURES

[76] Inventor: George R. Osborne, Sr., 2815-35th Ave., W., Seattle, Wash. 98199

[21] Appl. No.: 960,474

[22] Filed: Nov. 13, 1978

[51] Int. Cl.[3] ..... E04B 1/343

[52] U.S. Cl. ..... 52/69; 52/79.5; 16/128 R

[58] Field of Search ..... 52/66, 69, 71, 79.5, 52/70, 68, 72; 217/14, 15, 16, 46, 47, 48; 16/128 R, 135

[56] References Cited

U.S. PATENT DOCUMENTS

| | | | |
|---|---|---|---|
| 324,368 | 8/1885 | Curley | 16/128 R |
| 1,218,846 | 3/1917 | Farnquist | 217/14 |
| 1,768,793 | 7/1930 | Sheard | 49/381 |
| 3,968,618 | 7/1976 | Johnson | 52/71 |

FOREIGN PATENT DOCUMENTS

| | | | |
|---|---|---|---|
| 1324702 | 3/1963 | France | 52/69 |
| 230971 | 3/1925 | United Kingdom | 16/128 R |

*Primary Examiner*—John E. Murtagh
*Attorney, Agent, or Firm*—Christensen, O'Connor, Johnson & Kindness

[57] ABSTRACT

Initially folded wall panels connected by the novel hinge means to the sides of a common roof panel swing downwardly into upright positions as the roof panel is raised for integration into the composite building structure. The novel hinge means comprises a base plate disposed in a vertical plane perpendicular to the wall panel plane and having one leg bolted against the face of a wall panel stud and a transverse leg pivotally connected to a roof panel beam element at an elevated position spaced inwardly from the outer lower edge of the roof panel. In addition, a third leg perpendicular to the plane of the base plate is bolted against the face of a roof panel plate to reinforce the wall panel corner. Two or more such connecting hinges at opposite ends of the roof panel or at intervals along its length section provide the connecting hinge support for each wall panel in a length section module of the structure being erected.

1 Claim, 5 Drawing Figures

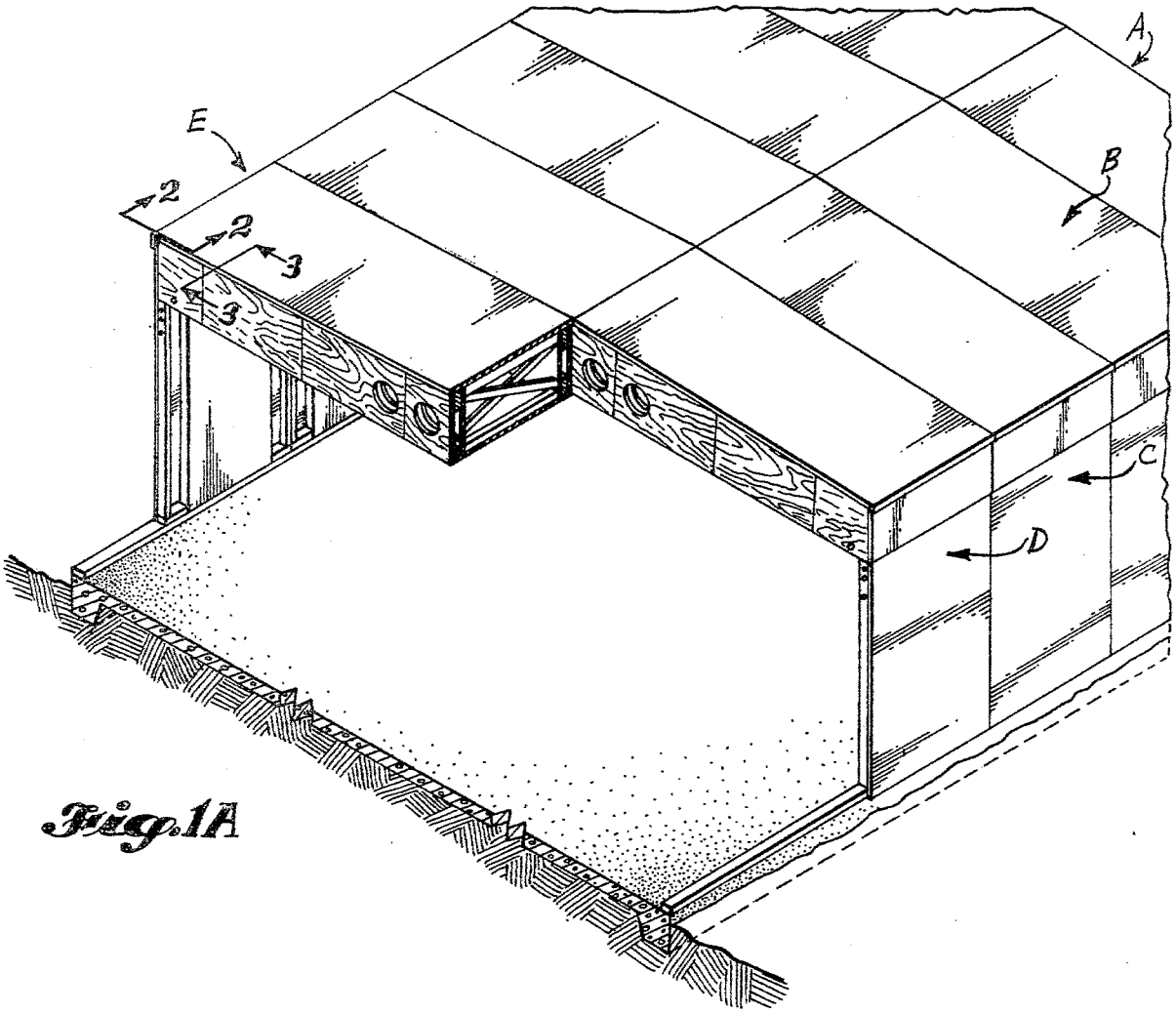
Fig. 1A
Fig. 1
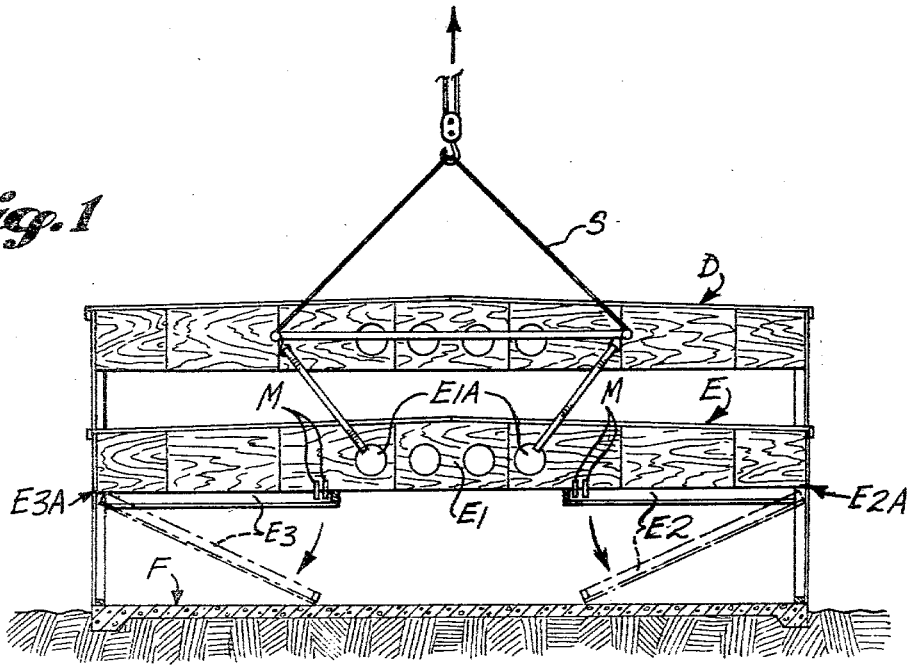

CONNECTING HINGE SYSTEM FOR PREFABRICATED BUILDING FOLDABLE PANEL STRUCTURES

BACKGROUND OF THE INVENTION

This invention relates to improvement in methods and devices used in prefabricated building construction. More particularly, the present invention is directed to a new and improved connecting hinge device and panel system incorporating the same for a method of erection in which a modular length roof panel is raised into position for integration with adjoining parts of the building structure and, with wall panels, initially folded under the roof panel, being gradually lowered into depending upright positions as the roof panel reaches design elevation. The invention is herein illustratively described by reference to the presently preferred embodiment thereof; however, it will be recognized that certain modifications and changes with respect to details may be made without departing from the essential features involved.

The present invention is directed to a novel joint reinforcement and connecting hinge means incorporated in prefabricated panel structures for use in foldable panel prefabricated building panel systems generally of the type disclosed in U.S. Pat. Nos. 3,968,618 (Johnson); 3,494,092 (Johnson); 3,953,947 (Heinrich); 3,97[illegible],185 (Heinrich) and 3,600,870 (Greenhalgh). Tenani, 3,838,902, is of limited interest regarding its hinging means.

The great increase of labor and materials costs in the construction of buildings of all types has required the industry to utilize prefabrication methods and many other economies wherever practicable, and in connection therewith to employ structural designs closely engineered for strength with maximum economy of parts and materials. In the design and construction of warehouse and auditorium buildings, for example, it has been found possible to effect large savings with full-span modular length section roof panels having foldable wall panels hingedly joined to opposite ends of the roof panel. Any desired number of such multi-panel modular length sections of standardized mutually compatible design can be joined together edge to edge progressively in order to provide a building of the desired length. When properly designed and constructed, no intermediate bearing walls or lateral stiffener partitions are necessary in a multi-section building erected by such methods. The structural integrity of the individual prefabricated roof and wall and the strength and proper placement of interconnections between them provides all the rigidity and strength required. In such systems it is found that large cost savings are realizable and safer, more rapid erection made possible on the building site if the wall and roof panels of a modular length section, initially folded into parallel relationship at the factory to be shipped and layed out at the site, are permitted to unfold automatically incident to the process of elevating the roof panel to installed height.

An important object of this invention is to provide an improved connecting hinge system that joins the foldable wall panels by their upper edges to the outer edges of the roof panel with the parts positionally interrelated and guided thereby to automatically assume their intended final positional relationship as the roof panel is elevated to its installed position. A more specific object is to devise a low-cost connecting hinge arrangement for that purpose that also serves as a reinforcement tie between intersection panel corner members of the wall panel section both during shipment and handling and in the final structure itself.

Still another object of the invention is to devise a connecting hinge and structural reinforcement corner member for modular length building panel sections permitting those sections to be transported and handled in mutually folded relationship and facilitating their incorporation in a completed building structure by guiding the members reliably and accurately into final positional relationship as they are moved in a single hoisting step into installed position.

BRIEF DESCRIPTION OF THE INVENTION

In accordance with this invention, the modular length roof panel and opposite wall panels are interconnected by a reinforcement hinging coupler at each corner, with or without intermediate similar connectors spaced between them. The wall panels initially are folded beneath the roof panel. Released therefrom for swinging downwardly, the wall panels gradually assume depending upright positions as the roof panel is hoisted into its installed position. Each such reinforcement coupling hinge device comprises a base plate that is bolted or otherwise secured to one face of a wall panel stud and that has a transverse leg in the same plane that connects by a bolt or pin serving as a hinge element to a joist or similar element in the roof panel. The connecting hinge point is displaced inwardly from the outer edge of the roof panel and upwardly from the interface between the wall panel top and the roof panel bottom so as to accommodate the arc of swing of the wall panel into abutment with the roof panel in the process of erection. In addition, the connector includes a transverse member perpendicular to the base plate that is bolted to a plate member in the wall panel so as to reinforce the corner structure of the latter. The parts and fastenings of the connecting hinge device are relatively inexpensive to manufacture and install, and reinforcing, reliably supporting and accurately positioning the panels relatively during the erection process provide a strong pivot joint in the final structure itself.

These and other features, objects and advantages of the invention will become more fully evident from the following description by reference to the accompanying drawings.

BRIEF DESCRIPTION OF THE DRAWINGS

FIG. 1 is an end elevation of a building structure in process of erection using the prefabricated foldable roof and wall panel module concept to which the invention is applied.

FIG. 1A is a simplified top perspective view of the partially completed structure.

DETAILED DESCRIPTION OF THE DRAWINGS

Figure 2:
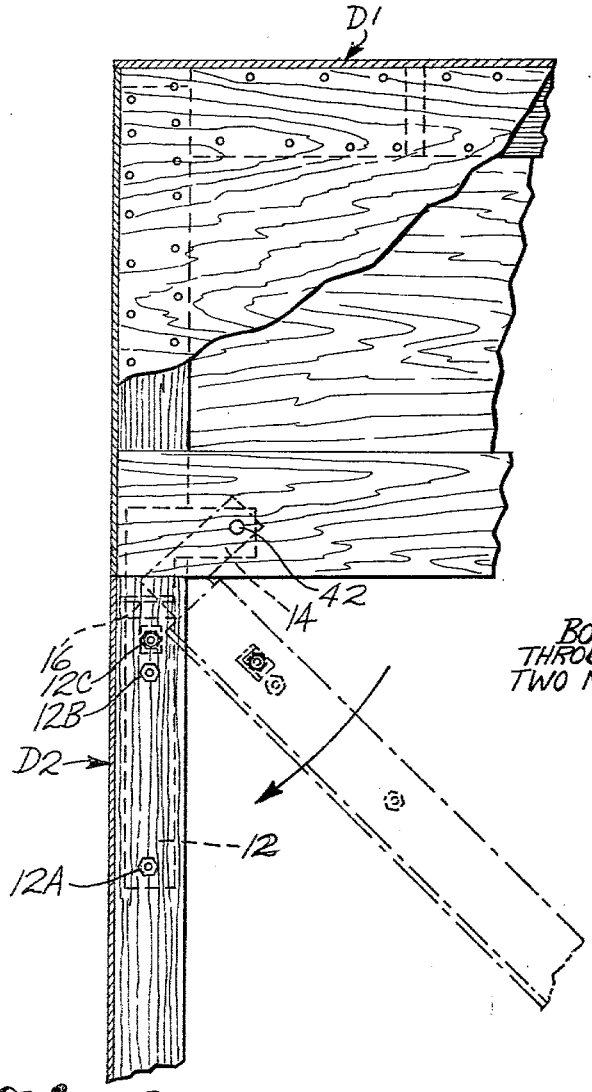
FIG. 2 is a partial sectional view taken on line 2—2 in FIG. 1A showing the improved reinforcement connecting hinge, the view being taken along the hinge axis.
Figure 3:
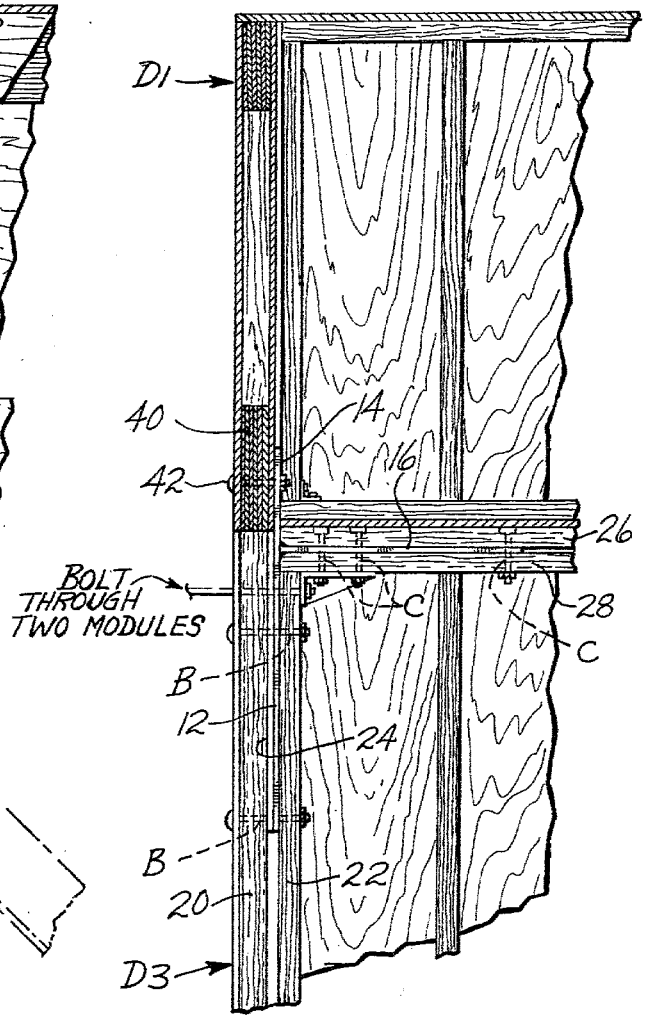
FIG. 3 is a partial sectional view taken on line 3—3 in FIG. 1A at right angles to the hinge axis (i.e., perpendicular to the wall panel).
Figure 4:
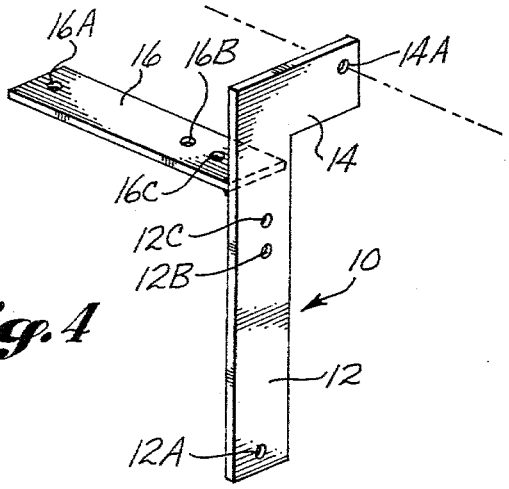
FIG. 4 is an isometric view of the preferred form of the reinforcement connecting hinge of the invention.

In FIGS. 1 and 1A the building structure under construction consists of an end wall A and a series of modular full-span roof panel and adjoining wall panel modules B, C, D, E, etc. Section B is joined to the side and top edges of end wall A and thereafter each succeeding section is joined to the other preceeding it in the series so as to form an open interior space which at the end will be closed by an opposite end wall (not shown). FIG. 1 depicts modular section D installed and modular section E being raised by a crane sling S with sling lifter straps passed through holes $E_{1A}$ in the box beam section of roof panel $E_1$ which holes are later used for piping, wiring, ducting, etc. Side wall section panels $E_2$ and $E_3$ held by temporary tie straps M folded along the underside of roof panel section $E_1$ are hinge-connected at $E_{2A}$ and $E_{3A}$ to the outer lower end edges of the roof panel as more clearly appears in succeeding figures. These straps are cut or removed at any suitable time upon placement of the folded multi-panel section on the site where it is to be elevated. Severance of straps M permits the side wall section panels $E_2$ and $E_3$ to hinge downwardly progressively as the roof panel is raised into installed position or after it is raised there. It is convenient, for example, to sever the tie straps M while the section module to be next emplaced in the structure lies on the building floor F in position next to the preceeding section ready for hoisting. In that way the bottom edges of the unfolding side wall panels $E_2$ and $E_3$ slide on the floor outwardly at a controlled rate as the roof panel $E_2$ is progressively elevated. A slight overelevation of the structural module at the last followed by lowering assists in placing the wall panel bottom plates onto the mud sills or wall footings so that anchor studs embedded in the footings can enter upwardly through predrilled holes in the mud plates for bolting down the latter. Details of this and other detailed design aspects of the structure may vary widely and therefore will not be illustrated or described further herein.

The invention itself concerns the hinging and reinforcement connection arrangement by which the upper edges of the foldable wall panel sections are hingedly connected to the roof panel section. Each wall panel section is so connected by at least two hinge units 10, one at each end. If desired, one or more intermediately located similar hinge units can also be used when greater stiffness is required or especially when an unusually long section module is employed. Hinge unit 10 comprises a flat, elongated base plate including leg portions 12 and 14 oriented mutually at right angles to each other forming an "L". Perpendicular to the base plate is an elongated connector/reinforcement plate 16 welded to one side of the base plate, slightly below the leg 14. Plate 16 lies in a horizontal plane with leg 12 in upright position in the completed building structure. Leg 14 has a hinge joint hole 14A near its projecting end. Leg 12 has fastener bolt holes 12A, 12B and 12C whereas plate 16 has fastener bolt holes 16A, 16B and 16C. With the roof panel horizontal, hinge pin hole 14A lies substantially above the horizontal plane of the plate 16.

When incorporated in the modular structure, such as roof panel D1 and wall panels D2 and D3, base plate leg 12A is secured in place by bolts B sandwiched between wall end column 20 and adjacent stud 22 with an accompanying plywood fill strip 24. Plate 16 is secured in place by bolts C sandwiched between wall top plate members 26 and 28. Thus, plate leg 12 and plate 16 serve as a strong and rigid reinforcement connection between the corner-forming members of the wall structure.

In addition, base plate leg 14 projects into the roof panel, into the space between the inner side of laminar lower edge beam 40 and adjacent box beam stud 41. Leg 14 is secured to beam 40 by a hinge pin in the form of bolt 42 passing through the beam.

As will be seen best in FIG. 2, the upwardly and inwardly offset location of hinge pin 42 above the bottom surface of roof panel D1 permits the upper plate surface of wall section D2 to move into direct abutment with the bottom of the ceiling or roof panel with all parts clearing each other as the wall panel swings downwardly on hinge pin 42 into its final upright position. The same pin 42 also serves to provide support against lateral shifting of the wall panel section relative to the roof panel section and to establish and maintain these components in the correct final position where additional fastenings may be installed to secure the structure more firmly together at a series of addition fastener points along its length.

These and other aspects of the invention including minor alternative design variations will be seen from an understanding of the illustrated embodiment thereof.

What is claimed is:

1. In a prefabricated building structure including hingedly connected roof panel and opposite wall panels foldable beneath the same and adapted to swing downwardly relative to the roof panel into depending upright positions with elevation of the roof panel, each of said wall panels having upright and horizontal structural members forming upper corners in the wall panel, connector hinge units each including a substantially flat base plate having first and second legs intersecting substantially in perpendicular relationship in a common vertical plane and further having a substantially flat transverse connector plate perpendicular to said base plate, said connector plate projecting at right angles from said first leg at a location intermediate one end of said first leg and its intersection with the second leg, said first leg and said transverse connector plate lying in mutually perpendicular planes and being respectively secured to such upright structural member and such horizontal structural member at said corner formed by such members, and means pivotally connecting the projecting end of said second leg to the roof panel to pivot thereon about a horizontal axis, whereby to guide the wall panel upper end into abutment with the underside of the roof panel adjacent the end of the latter when the wall panel is swung into upright position, said wall panel upright and horizontal structural members each comprising paired parallel members, the first leg and connector plate being bolted in position closely sandwiched between the members of the respective pairs.

* * * * *